US012492880B2

(12) United States Patent
Roberson et al.

(10) Patent No.: US 12,492,880 B2
(45) Date of Patent: Dec. 9, 2025

(54) ACCESSORY MOUNT

(71) Applicant: Arisaka LLC, Apex, NC (US)

(72) Inventors: William Roberson, Apex, NC (US); Andrew Damgaard, Lincoln, NE (US)

(73) Assignee: Arisaka LLC, Apex, NC (US)

( * ) Notice: Subject to any disclaimer, the term of this patent is extended or adjusted under 35 U.S.C. 154(b) by 0 days.

(21) Appl. No.: 18/895,578

(22) Filed: Sep. 25, 2024

(65) Prior Publication Data

US 2025/0116474 A1 Apr. 10, 2025

Related U.S. Application Data

(60) Provisional application No. 63/542,945, filed on Oct. 6, 2023.

(51) Int. Cl.
*F41A 23/10* (2006.01)
*F41A 23/14* (2006.01)

(52) U.S. Cl.
CPC ..... *F41A 23/10* (2013.01); *F41A 23/14* (2013.01)

(58) Field of Classification Search
CPC ..... F41A 23/10; F41A 23/14
See application file for complete search history.

(56) References Cited

U.S. PATENT DOCUMENTS 3,750,318 A * 8/1973 Burris ..... F41G 11/003 42/127
5,033,219 A * 7/1991 Johnson ..... F41G 1/35 42/126
5,086,566 A * 2/1992 Klumpp ..... F41G 11/003 42/126
5,570,529 A * 11/1996 Amelino ..... F41G 11/003 42/124
7,077,582 B2 7/2006 Johnson
7,222,451 B2 * 5/2007 Keng ..... F41A 23/08 89/37.04
8,276,307 B2 * 10/2012 Deros ..... F41G 11/003 42/127
8,458,946 B1 * 6/2013 Pintsch ..... F41A 23/08 89/37.04
8,578,647 B2 11/2013 Storch et al.
9,551,550 B2 * 1/2017 Wells ..... F41C 27/00
9,677,853 B2 * 6/2017 Haugen ..... F41G 11/005
10,036,614 B1 7/2018 Ruiz
10,466,011 B2 * 11/2019 Swan ..... F41C 33/0263
(Continued)

*Primary Examiner* — Michelle Clement
(74) *Attorney, Agent, or Firm* — Asgaard Patent Services, LLC; F. Wayne Thompson, Jr.

(57) ABSTRACT

Disclosed is an accessory mount configured for attachment to a rail interface system, such as the MIL-STD 1913 Picatinny rail. In particular, the accessory mount is a multi-position sliding mount that can be used to attach an accessory, such as a bipod or a tripod, to a handguard equipped with a compatible rail interface system. The accessory mount includes a spring-loaded push-button recoil lug that allows it to be quickly repositioned on a rail interface system. The accessory mount also includes an adjustment knob configured to facilitate attachment and removal without the need to slide the accessory mount on or off the end of the rail interface system. Additionally, the adjustment knob is configured to set sliding tension for the accessory mount and, if desired, to fix the accessory mount in position on the rail interface system.

9 Claims, 12 Drawing Sheets

(56) References Cited

U.S. PATENT DOCUMENTS

| | | | | |
|---|---|---|---|---|
| 10,935,348 | B2 * | 3/2021 | Liu | F41C 27/00 |
| 10,948,266 | B2 * | 3/2021 | Wells | F41G 1/345 |
| 11,242,951 | B2 * | 2/2022 | Johnson, Sr. | F41G 11/00 |
| 11,307,000 | B2 * | 4/2022 | Ma | F41G 11/003 |
| 11,473,872 | B2 * | 10/2022 | Pischke | F41C 27/00 |
| 11,512,808 | B2 * | 11/2022 | Johnson, Sr. | F41G 11/003 |
| 11,585,620 | B2 * | 2/2023 | Raley | F41A 19/43 |
| 11,608,970 | B2 * | 3/2023 | Jiang | F41G 1/35 |
| 11,754,373 | B2 * | 9/2023 | Connolly | F41G 11/003 42/111 |
| 11,802,658 | B1 | 10/2023 | Huang | |
| 11,976,777 | B2 * | 5/2024 | Johnson, Sr. | F41G 11/003 |
| 11,982,511 | B2 * | 5/2024 | Melville | F41G 11/003 |
| 12,007,202 | B2 * | 6/2024 | Stern | F41G 11/003 |
| 12,152,850 | B2 * | 11/2024 | Ståhl | F41A 21/484 |
| 12,152,853 | B1 * | 11/2024 | Bray | F41A 25/16 |
| 12,203,728 | B2 * | 1/2025 | Lindsay | F41G 11/003 |
| 12,259,218 | B2 * | 3/2025 | Zheng | F41G 11/003 |
| 12,305,795 | B2 * | 5/2025 | Johnson, Sr. | F41G 11/00 |
| 2004/0068913 | A1 * | 4/2004 | Solinsky | F41G 1/35 42/146 |
| 2008/0040965 | A1 * | 2/2008 | Solinsky | F41G 1/345 42/90 |
| 2013/0148367 | A1 * | 6/2013 | Sharrah | F21V 21/34 362/396 |
| 2017/0261288 | A1 * | 9/2017 | Bartoszewicz | F41G 11/003 |
| 2021/0108892 | A1 * | 4/2021 | Ma | F41C 27/00 |
| 2022/0163292 | A1 * | 5/2022 | Kilic | F41G 11/003 |
| 2023/0349671 | A1 * | 11/2023 | Morrison | F41G 11/003 |
| 2025/0093130 | A1 * | 3/2025 | Mayville | F41G 11/003 |
| 2025/0116474 | A1 * | 4/2025 | Roberson | F41G 11/003 |
| 2025/0224212 | A1 * | 7/2025 | Johnson, Sr. | F41G 11/003 |
| 2025/0264710 | A1 * | 8/2025 | Friedman | G02B 23/18 |

* cited by examiner

ACCESSORY MOUNT

CROSS-REFERENCE TO RELATED APPLICATION(S)

This application claims the benefit of U.S. Provisional Application Ser. No. 63/542,945, filed on Oct. 6, 2023, the entirety of which is incorporated herein by reference.

TECHNICAL FIELD

This disclosure relates to implementations of an accessory mount.

BACKGROUND

Rail interface systems, such as the MIL-STD-1913 rail and the STANAG 4694 rail, are routinely used to facilitate the attachment of accessories to firearms. These rail interface systems are characterized by the presence of multiple transverse slots, each evenly spaced along the rail at precise intervals. This design allows for the secure attachment of accessories, such as sights, grips, lights, and multi-function aiming lasers. The dimensions and slot spacing are standardized, making these rail interface systems compatible with a wide array of firearm accessories.

The ARCA Swiss rail interface was initially designed for photography but is now being used by the precision shooting community. ARCA Swiss rails are characterized by their rectangular, dovetail design. The shape allows for a sliding action and user-selectable mounting positions along the length of the rail interface. Furthermore, ARCA Swiss-compatible mounts typically include a clamp mechanism for quick attachment or detachment of accessories without the need for tools.

It would therefore be advantageous to have a mount for firearm accessories that can attach to the standardized rail interface systems typically found on firearms, while also offering the quick, sliding longitudinal adjustments provided by mounts compatible with the ARCA Swiss rail.

Accordingly, there exists a need for the accessory mount disclosed herein. The present invention is primarily directed towards providing an accessory mount configured to address these and other needs.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is an accessory mount configured for attachment to a rail interface system, such as the MIL-STD 1913 Picatinny rail. In particular, the accessory mount is a multi-position sliding mount that can be used to attach an accessory, such as a bipod or a tripod, to a handguard equipped with a compatible rail interface system. The accessory mount includes a spring-loaded push-button recoil lug that allows it to be quickly repositioned on the rail interface system. The accessory mount also includes an adjustment knob configured to facilitate attachment and removal without the need to slide the accessory mount on or off the end of the rail interface system. Additionally, the adjustment knob is configured to set sliding tension for the accessory mount and, if desired, to fix the accessory mount in position on the rail interface system.

An example accessory mount comprises: a base comprising a receiving groove; a clamp comprising a receiving groove; a push-button recoil lug comprising an actuating arm, with an actuation button on one end and a recoil lug on the opposite end; and an adjustment knob. A channel is defined between the receiving groove of the base and the receiving groove of the clamp. The clamp is connected to the base by a threaded shank attached to the adjustment knob. Rotation of the adjustment knob causes the clamp to move relative to the base, thereby selectively varying the width of the channel. The push-button recoil lug is slidably positioned within a guide groove in the base and configured to removably position the recoil lug in the channel.

Another example accessory mount comprises: a base comprising a receiving groove; a clamp comprising a receiving groove; a push-button recoil lug comprising an actuating arm, with an actuation button on one end and a recoil lug on the opposite end; a spring; and an adjustment knob. A channel is defined between the receiving groove of the base and the receiving groove of the clamp. The clamp is connected to the base by a threaded shank attached to the adjustment knob. Rotation of the adjustment knob causes the clamp to move relative to the base, thereby selectively varying the width of the channel. The push-button recoil lug is slidably positioned within a guide groove in the base and configured to removably position the recoil lug within the channel. The push-button recoil lug is biased by the spring, which is positioned within a socket adjacent to the guide groove in the base.

Yet another example accessory mount comprises: a base comprising a receiving groove; a clamp comprising a receiving groove; a push-button recoil lug comprising an actuating arm, with an actuation button on one end and a recoil lug on the opposite end; an adjustment knob; a spring; and a collar. A channel is defined between the receiving groove of the base and the receiving groove of the clamp. The clamp is connected to the base by a threaded shank attached to the adjustment knob. Rotation of the adjustment knob causes the clamp to move relative to the base, thereby selectively varying the width of the channel. The adjustment knob includes a neck positioned within a bore on a lateral side of the clamp. The spring and the collar are also positioned within the bore, with the collar being biased against a distal end of the adjustment knob by the spring. Cooperating mating surfaces on the collar and the distal end of the adjustment knob are configured to resist rotational movement of the adjustment knob until sufficient rotational force is applied to the adjustment knob. The push-button recoil lug is slidably positioned within a guide groove in the base and configured to removably position the recoil lug in the channel.

BRIEF DESCRIPTION OF THE DRAWINGS

Like reference numerals refer to corresponding parts throughout the several views of the drawings.

DETAILED DESCRIPTION

Figure 1:
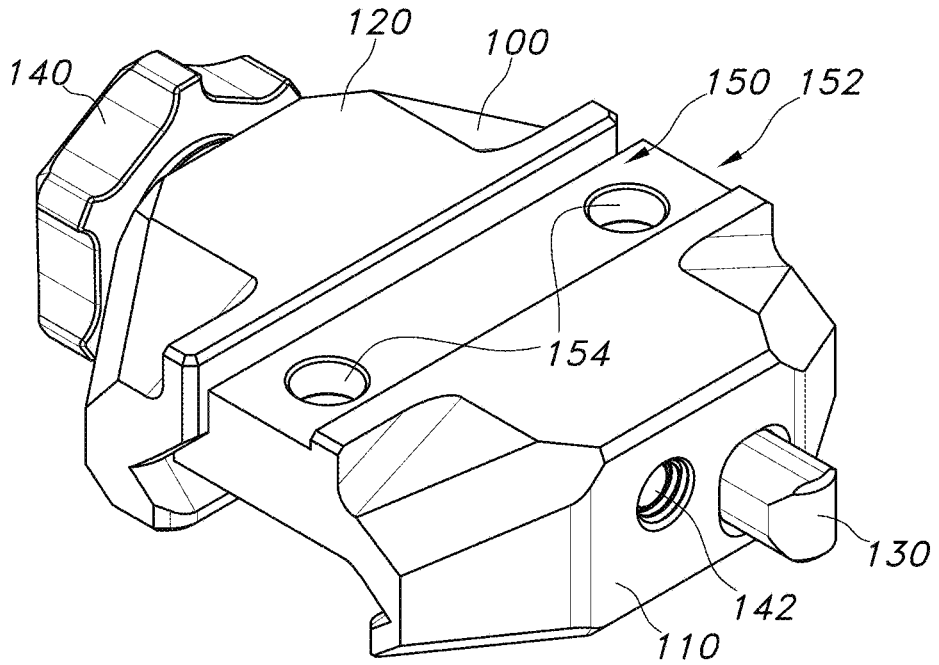
FIG. 1 is an isometric view of an accessory mount according to the principles of the present disclosure.
Figure 2:
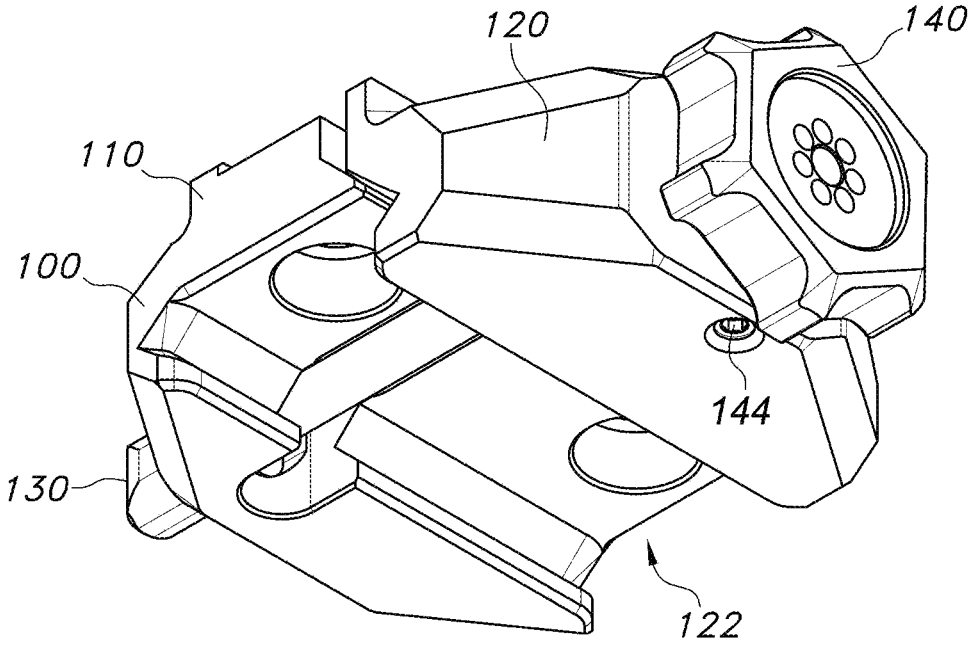
FIG. 2 is another isometric view of the accessory mount shown in FIG. 1.
Figure 3:
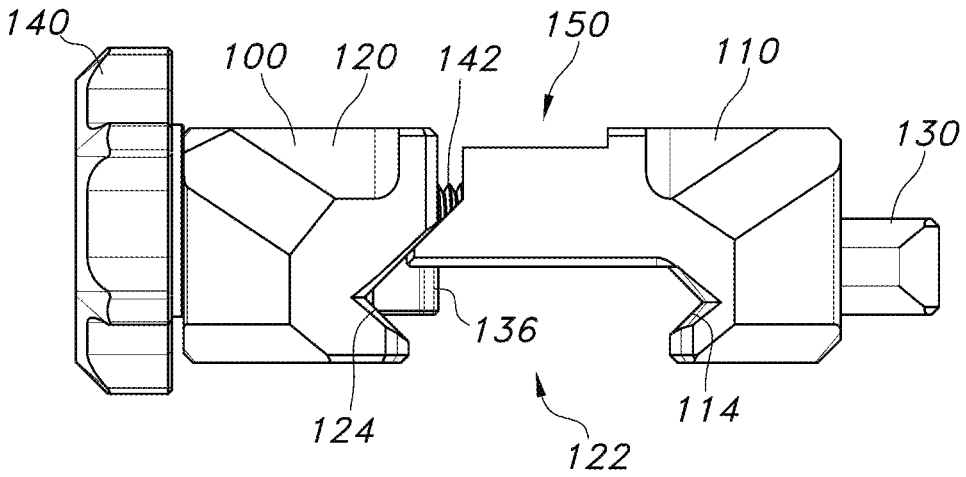
FIGS. 3-6 are side elevational views of the accessory mount shown in FIG. 1.
Figure 4:
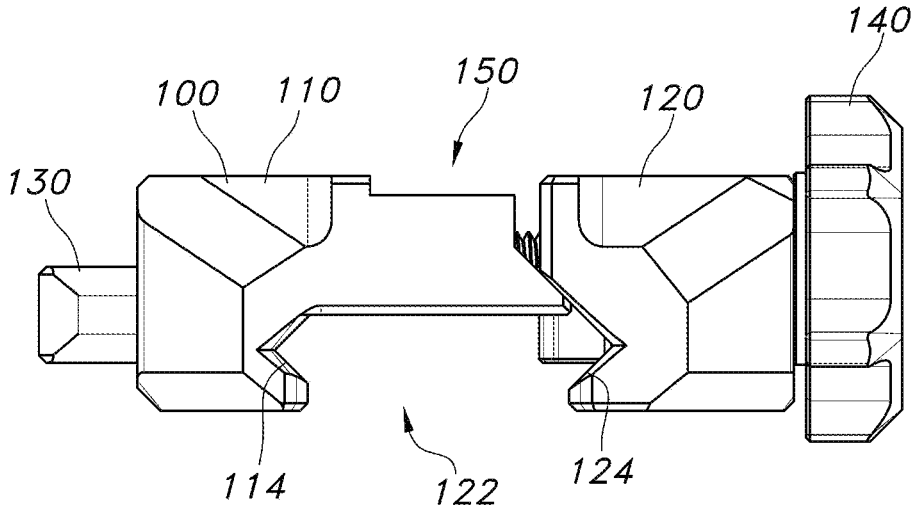
Figure 5:
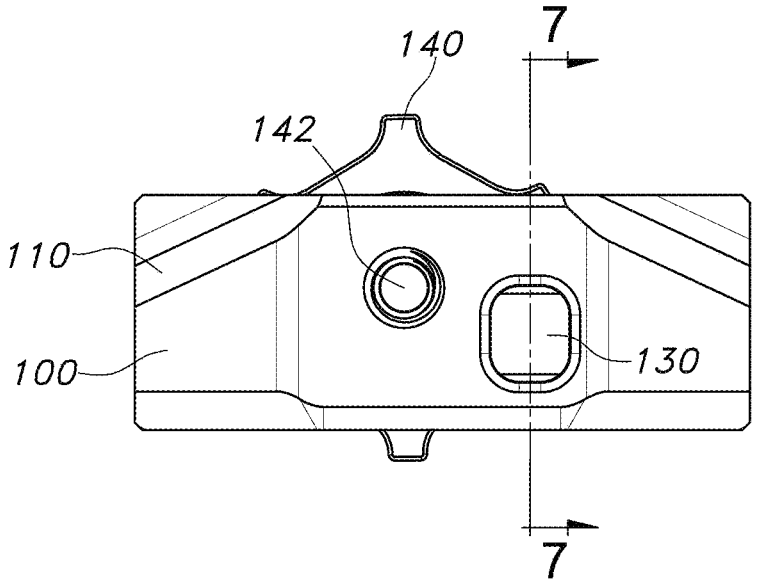
Figure 6:
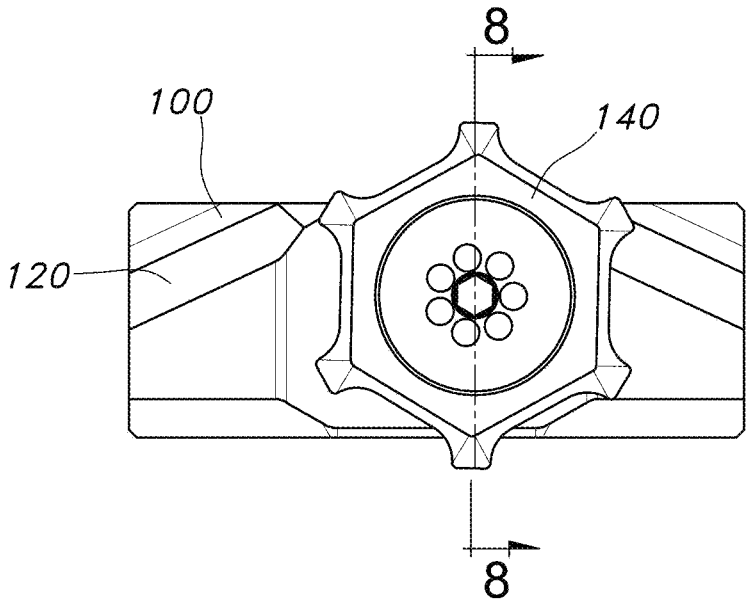

FIGS. 1-12 illustrate an example accessory mount 100 according to the principles of the present disclosure. The accessory mount 100 is a multi-position sliding mount configured for attachment to a rail interface system 104, such as the MIL-STD 1913 Picatinny rail. In particular, the accessory mount 100 can be used to attach accessories, such as a bipod 108 or a tripod to a handguard 102 equipped with a compatible rail interface system 104.

The accessory mount 100 includes a spring-loaded push-button recoil lug 130 that allows the accessory mount 100 to be quickly repositioned on a rail interface system 104. The accessory mount 100 also includes an adjustment knob 140 configured to facilitate attachment and removal without the need to slide the accessory mount 100 on or off the end of the rail interface system 104. Additionally, the adjustment knob 140 is configured to set sliding tension for the accessory mount 100 and, if desired, to fix the accessory mount 100 in position on the rail interface system 104.

The accessory mount 100 comprises a base 110, a clamp 120, a push-button recoil lug 130, and an adjustment knob 140.

Together, the base 110 and the clamp 120 form a channel 122 having opposed receiving grooves 114, 124. The receiving groove 114 on the base 110 and the receiving groove 124 on the clamp 120 are each configured to receive a mounting rail of the rail interface system 104. The clamp 120 is slidably connected to the base 110 by a threaded shank 142 attached to the adjustment knob 140. Movement of the clamp 120 selectively adjusts the width of the channel 122 and is accomplished through manual rotation of the adjustment knob 140. The adjustment knob 140 permits quick adjustment to the spacing between the receiving grooves 114, 124 so that the channel 122 of the accessory mount 100 may selectively grip or release a rail interface system 104. The push-button recoil lug 130 is slidably positioned within a guide groove 112 in the base 110 of the accessory mount 100 and comprises an actuating arm 132, with an actuation button 134 on one end and a recoil lug 136 on the opposite end. The push-button recoil lug 130 removably positions the recoil lug 136 in the channel 122 of the accessory mount 100, and thereby within a transverse groove 106 defined by the rail interface system 104 to which the accessory mount 100 is attached. Displacing the recoil lug 136 from the channel 122 allows the accessory mount 100 to slide on the rail interface system 104. This is achieved through manual operation of the actuation button 134, which extends from a lateral side of the base 110. The accessory mount 100 can only slide on the rail interface system 104 if the adjustment knob 140 has not been used to fix the accessory mount 100 in position.

Together, the base 110 and the clamp 120 also form a mounting interface 150 (e.g., an ARMS 17-S interface) used to attach accessories, such as bipods and tripods, to the accessory mount 100. The mounting interface 150 is a channel or groove 152 running along the length of the accessory mount 100 and a pair of mounting bores 154 extending through the base 110. The pair of mounting bores 154 in the base 110 may be counterbored (see, e.g., FIG. 2).

Figure 7:
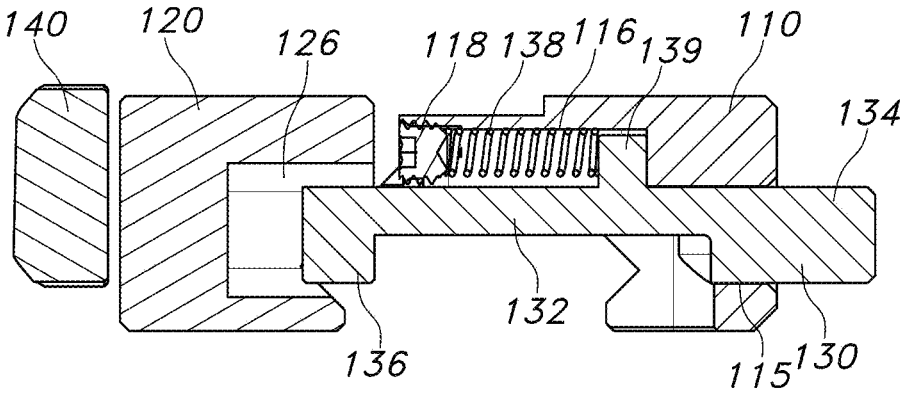
FIG. 7 is a side cutaway view of the accessory mount taken along reference line 7-7 shown in FIG. 5.
Figure 7A:
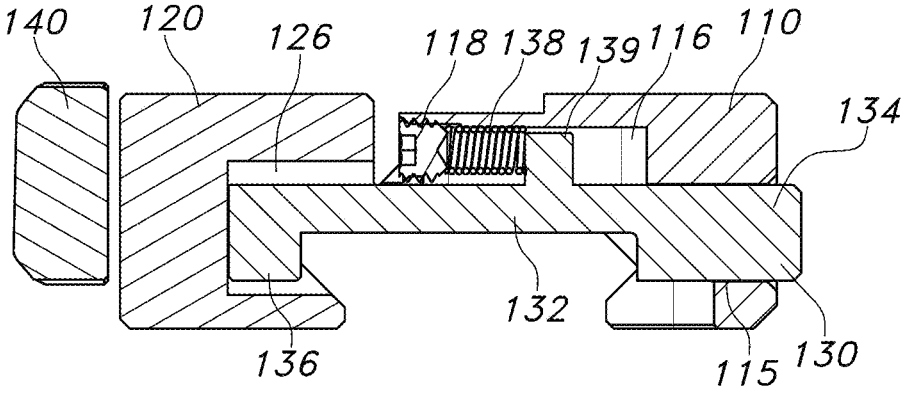
FIG. 7A is another side cutaway view of the accessory mount shown in FIG. 7, in which the push-button recoil lug is shown laterally displaced within the guide groove.

As shown in FIG. 7, the push-button recoil lug 130 is biased into position by a spring 138 (e.g., a coil spring) disposed within a socket 116 located above the guide groove 112 in the base 110. One end of the socket 116 is closed by a set screw 118. The spring 138 presses against a bias lug 139 of the push-button recoil lug 130 extending into the socket 116 through a longitudinal slot, thereby assisting in maintaining the recoil lug 136 in position within the channel 122 formed between the base 110 and clamp 120. The bias lug 139 extends from a longitudinal side of the actuating arm 132. The actuation button 134 is a rounded end of the actuating arm 132 that extends through an opening 115 in the side of the base 110. A substantially rectangular recess 126 is defined within the receiving groove 124 of the clamp 120. The recess 126 is configured to slidably receive the recoil lug 136 when the recoil lug 136 is laterally displaced from the channel 122 of the accessory mount 100 (see, e.g., FIG. 7A).

Figure 8:
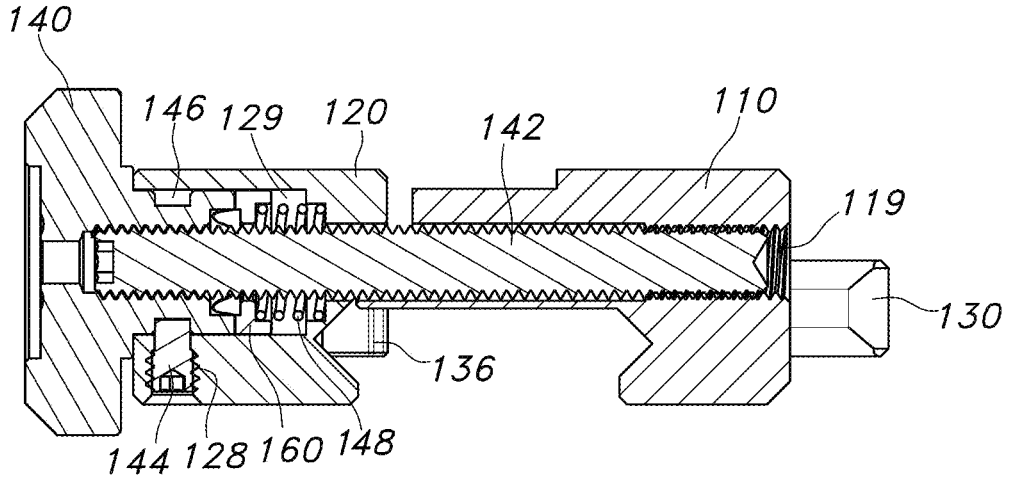
FIG. 8 is a side cutaway view of the accessory mount taken along reference line 8-8 shown in FIG. 6.
Figure 9:
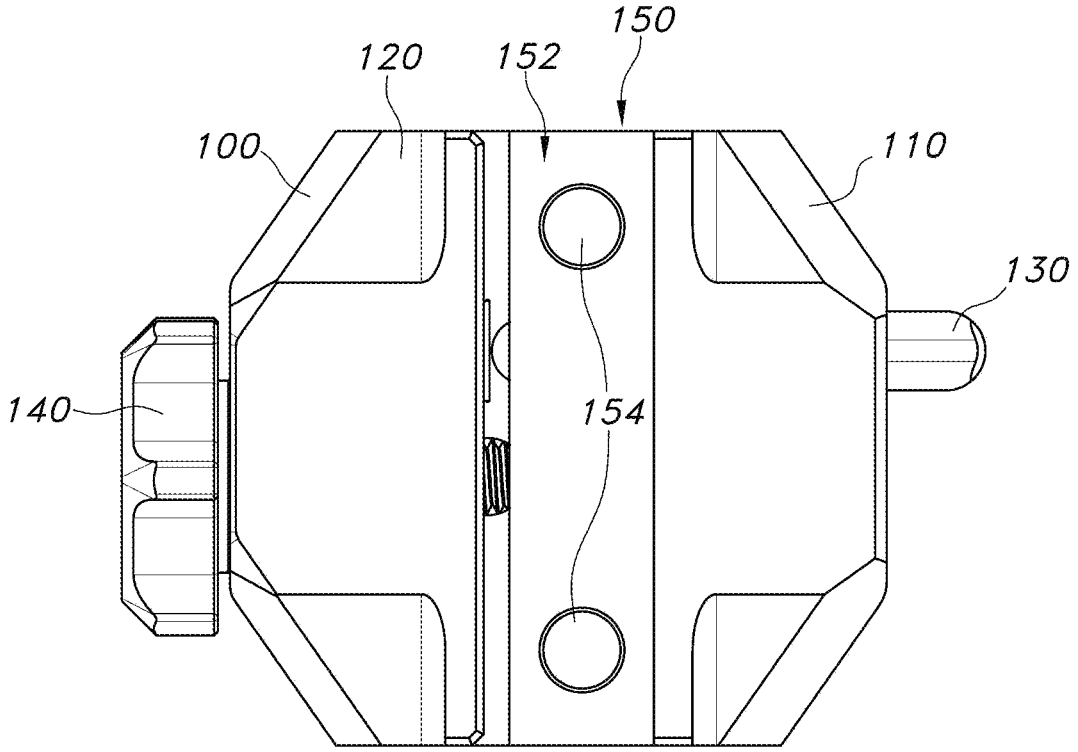
FIG. 9 is a plan view of the accessory mount shown in FIG. 1.
Figure 10:
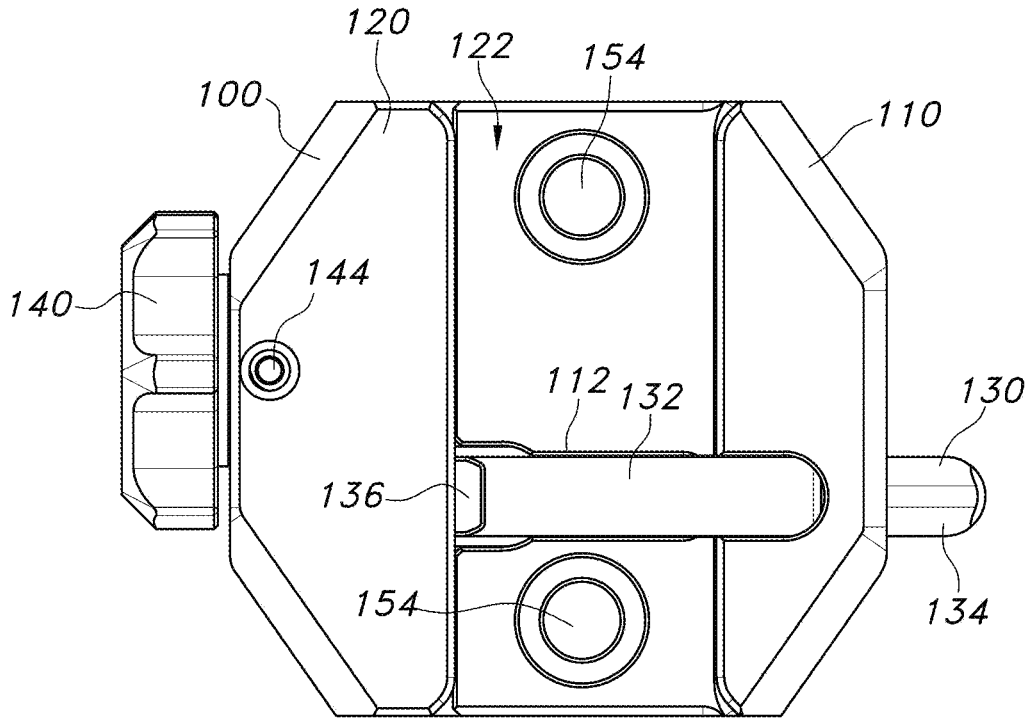
FIG. 10 is another plan view of the accessory mount shown in FIG. 1.
Figure 11:
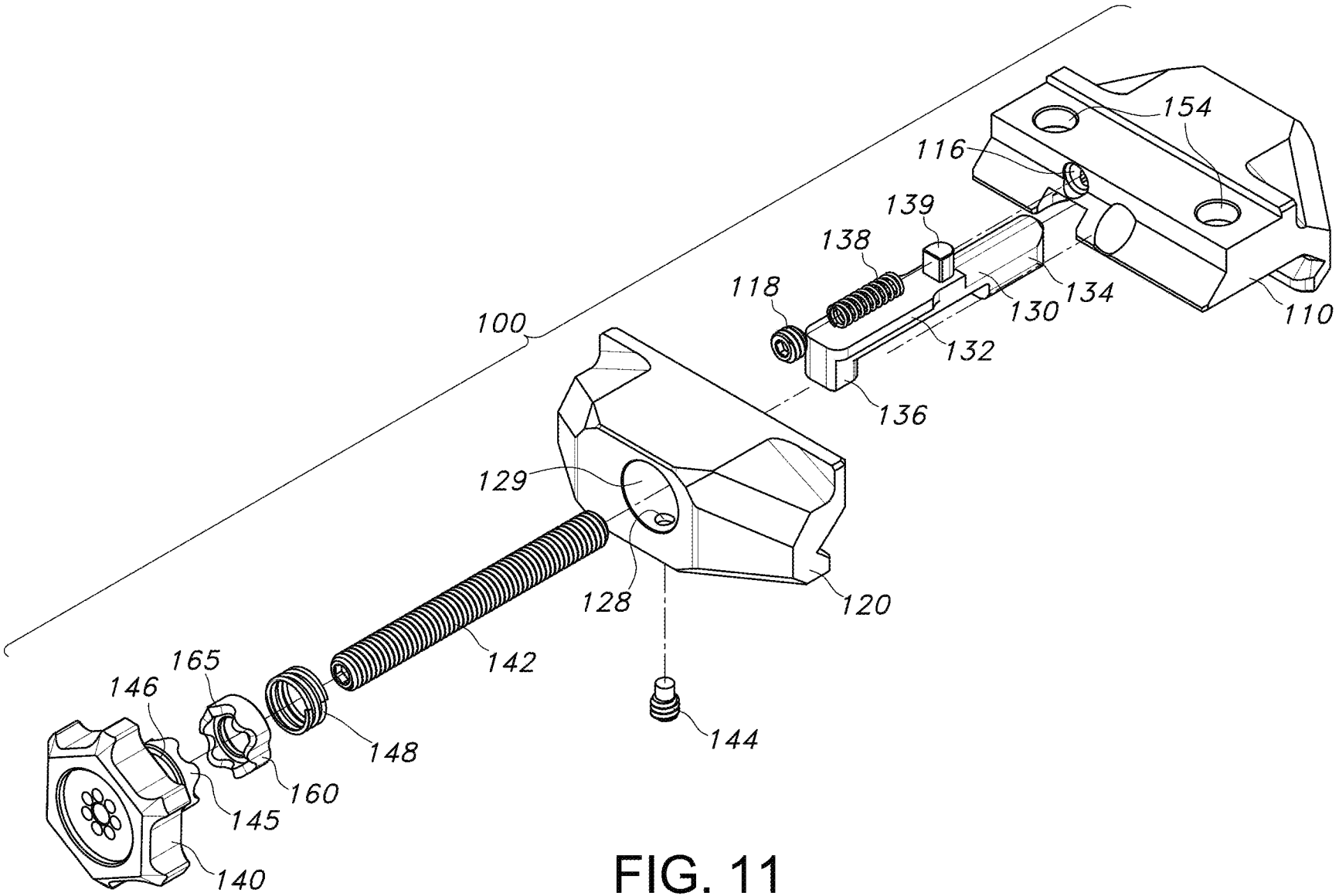
FIG. 11 is an exploded isometric view of the accessory mount shown in FIG. 1.
Figure 12:
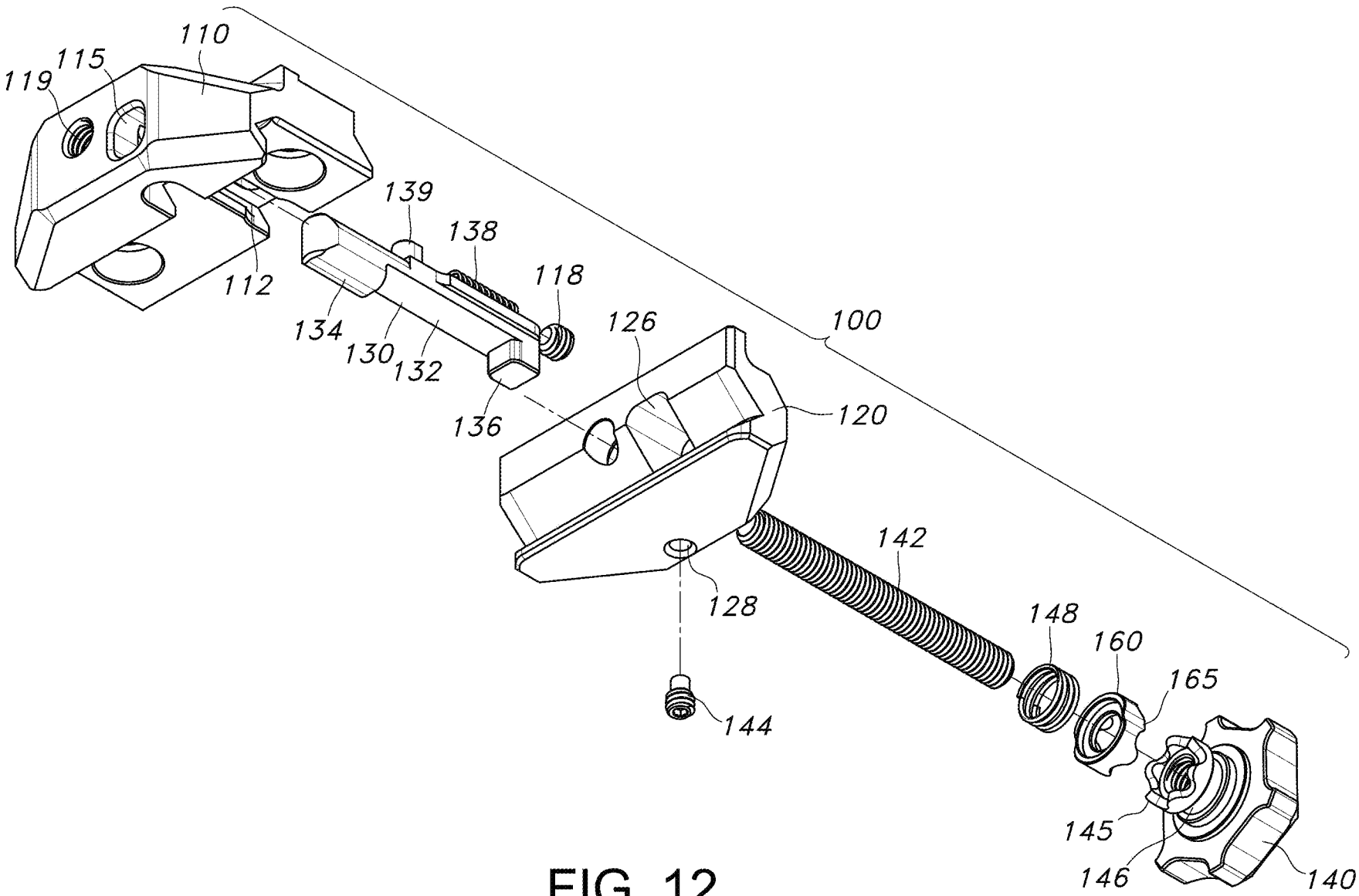
FIG. 12 is another exploded isometric view of the accessory mount shown in FIG. 1.

As shown in FIG. 8, the adjustment knob 140 is rotatably attached to the clamp 120 by a fastener 144. The fastener 144 is threadedly received by an opening 128 in the clamp 120. A tip of the fastener 144 extends through the opening 128 and is received within a circumferential groove 146 in the neck of the adjustment knob 140, thereby rotatably coupling the adjustment knob 140 to the clamp 120. The neck is positioned within a bore 129 in a lateral side of the clamp 120, along with a coil spring 148 and a collar 160. The collar 160 is biased against the distal end of the adjustment knob 140 by the coil spring 148. The collar 160 cooperates with the distal end of the adjustment knob 140 to retain the adjustment knob 140 in position. Cooperating mating surfaces 145, 165 on the adjustment knob 140 and the collar 160 are configured to facilitate a 60-degree rotation of the threaded shank 142 for each turn of the adjustment knob 140. The base 110 of the accessory mount 100 includes a threaded bore 119 configured to receive a portion of the threaded shank 142 attached to the adjustment knob 140.

Figure 13:
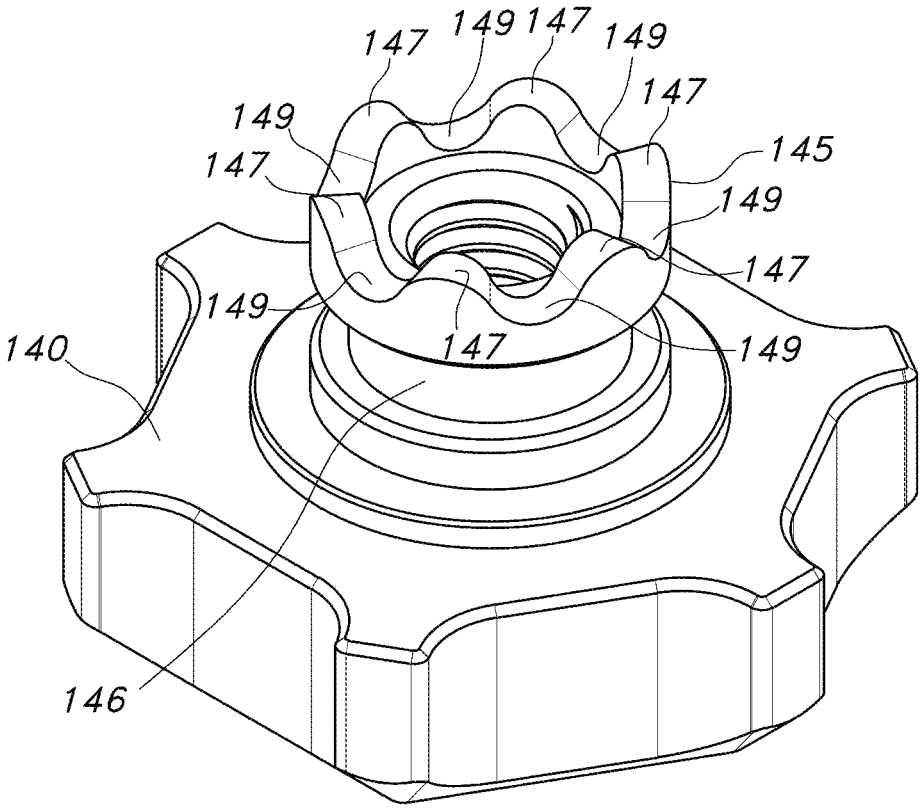
FIG. 13 is an isometric view of an adjustment knob according to the principles of the present disclosure.
Figure 14:
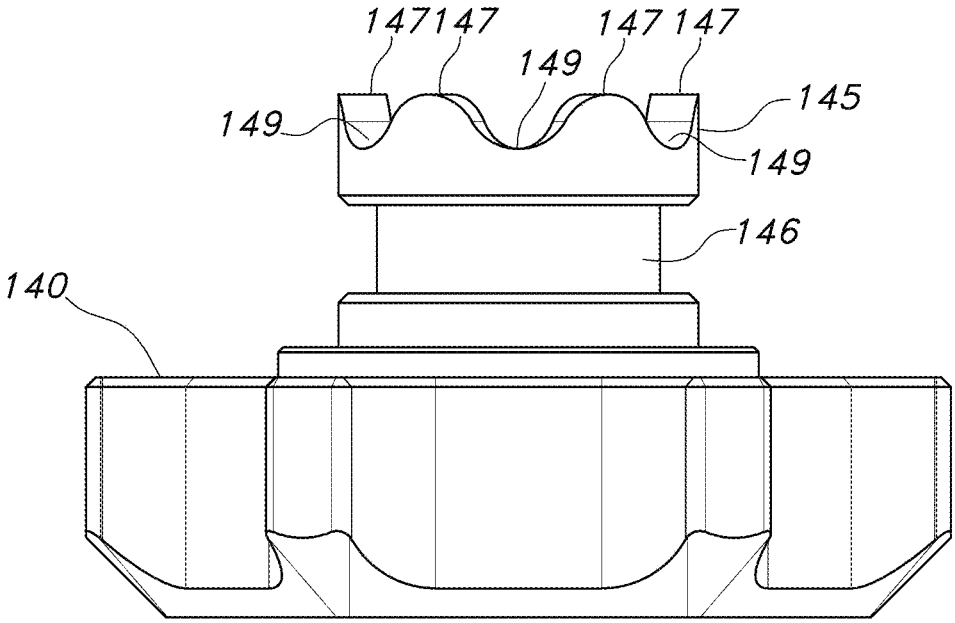
FIG. 14 is a side elevational view of the adjustment knob shown in FIG. 13.

As shown in FIGS. 13 and 14, the mating surface 145 of the adjustment knob 140 includes a series of convex lobes 147 and concave spaces 149 between the lobes 147, with the lobes 147 and spaces 149 evenly distributed around the end of the adjustment knob 140. The lobes 147 and spaces 149 between the lobes 147 are preferably arcuate or curved and are connected to one another in an alternating, end-to-end manner. Although six lobes 147 and six spaces 149 are illustrated in FIG. 14, it will be appreciated that the end of the adjustment knob 140 may be configured to form more or fewer lobes and/or spaces in a symmetric or asymmetric pattern.

Figure 15:
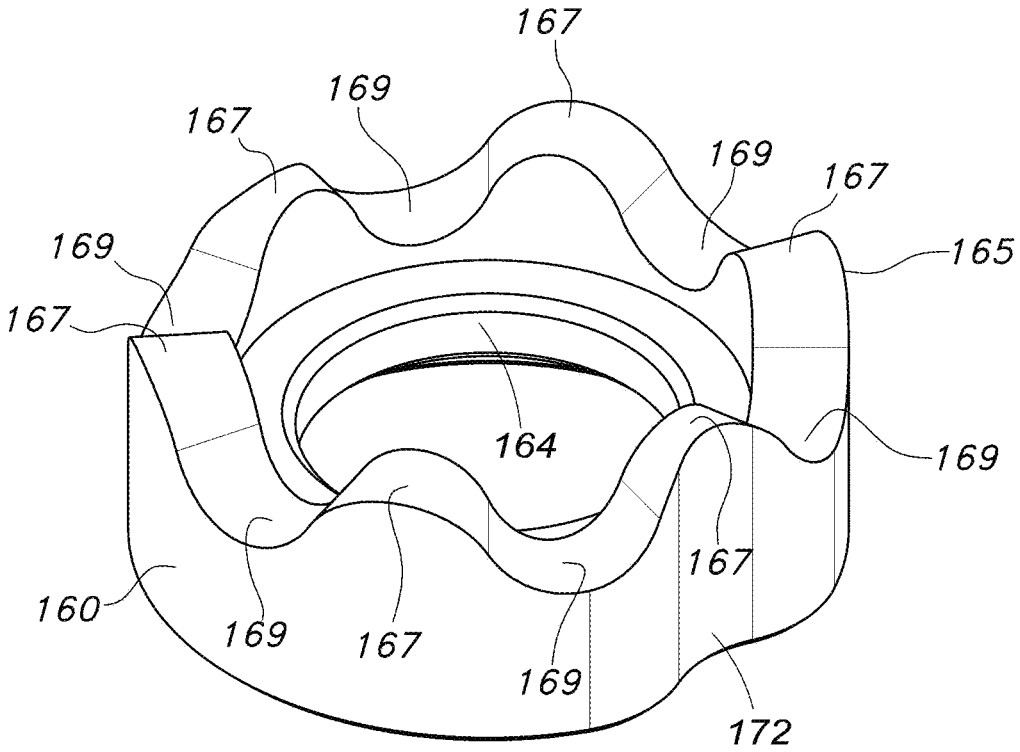
FIG. 15 is an isometric view of a collar according to the principles of the present disclosure.
Figure 16:
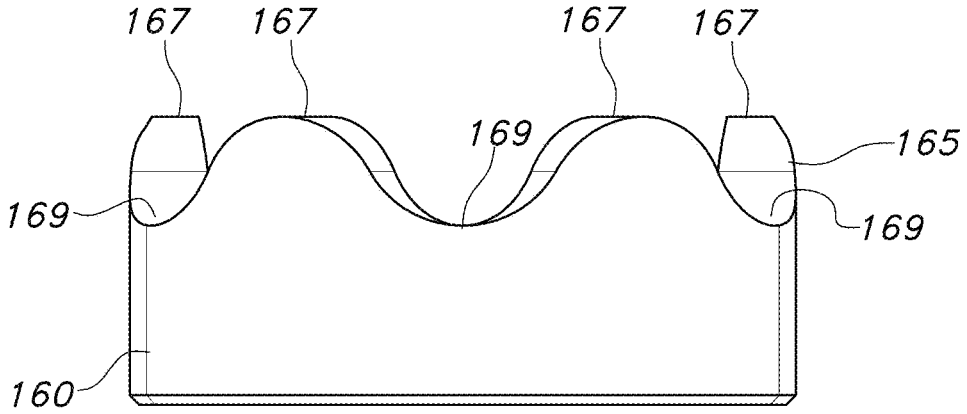
FIG. 16 is a side elevational view of the collar shown in FIG. 15.
Figure 17:
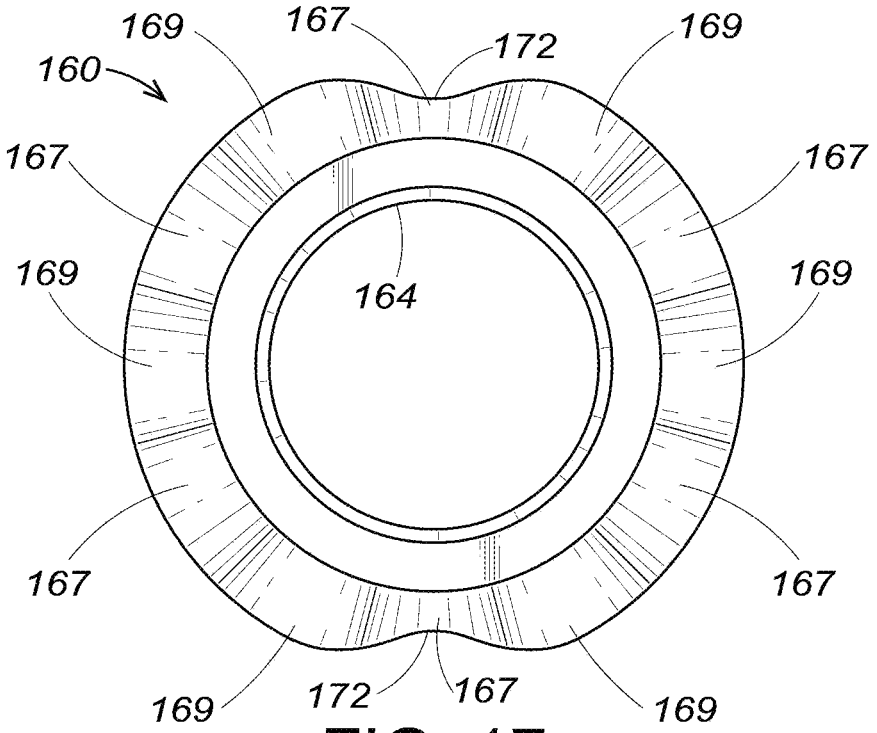
FIG. 17 is a front elevational view of the collar shown in FIG. 15.

As shown in FIGS. 15 and 16, the mating surface 165 of the collar 160 includes a series of convex lobes 167 and concave spaces 169 between the lobes 167, with the lobes 167 and spaces 169 evenly distributed around the face of the collar 160. The lobes 167 and spaces 169 between the lobes 167 are preferably arcuate or curved and are connected to one another in an alternating, end-to-end manner. The lobes 167 and spaces 169 therebetween are configured (e.g., spaced and positioned) to engage with the spaces 149 and lobes 147 on the end of the adjustment knob 140. The spaces 169 between the lobes 167 are sized and contoured to provide a rotational slip fit with the lobes 147 on the end of the adjustment knob 140. The end of the collar 160 opposite the mating surface 165 includes a counterbore 162 configured to receive a portion of the coil spring 148 (see, e.g., FIG. 8). The collar 160 also has a central opening 164 through which a portion of the threaded shank 142 extends. Indexing grooves 172 positioned on opposite lateral sides of the collar 160 are configured to interlock with corresponding curved projections positioned within the bore 129 of the clamp 120. In this way, rotation of the collar 160 is prevented. It is also envisioned that the collar 160 can be secured against rotation within the bore 129 in other ways, such as through the use of an adhesive.

Figure 18:
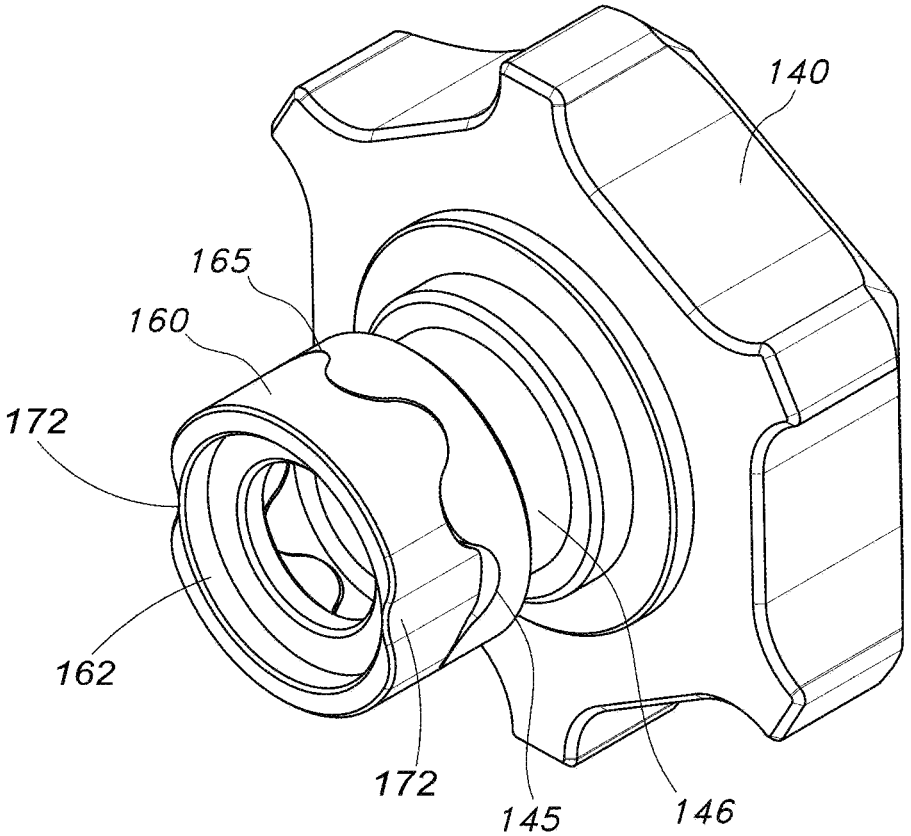
FIG. 18 is an isometric view of the adjustment knob shown in FIG. 13 and the collar shown in FIG. 15 in cooperative engagement.
Figure 19:
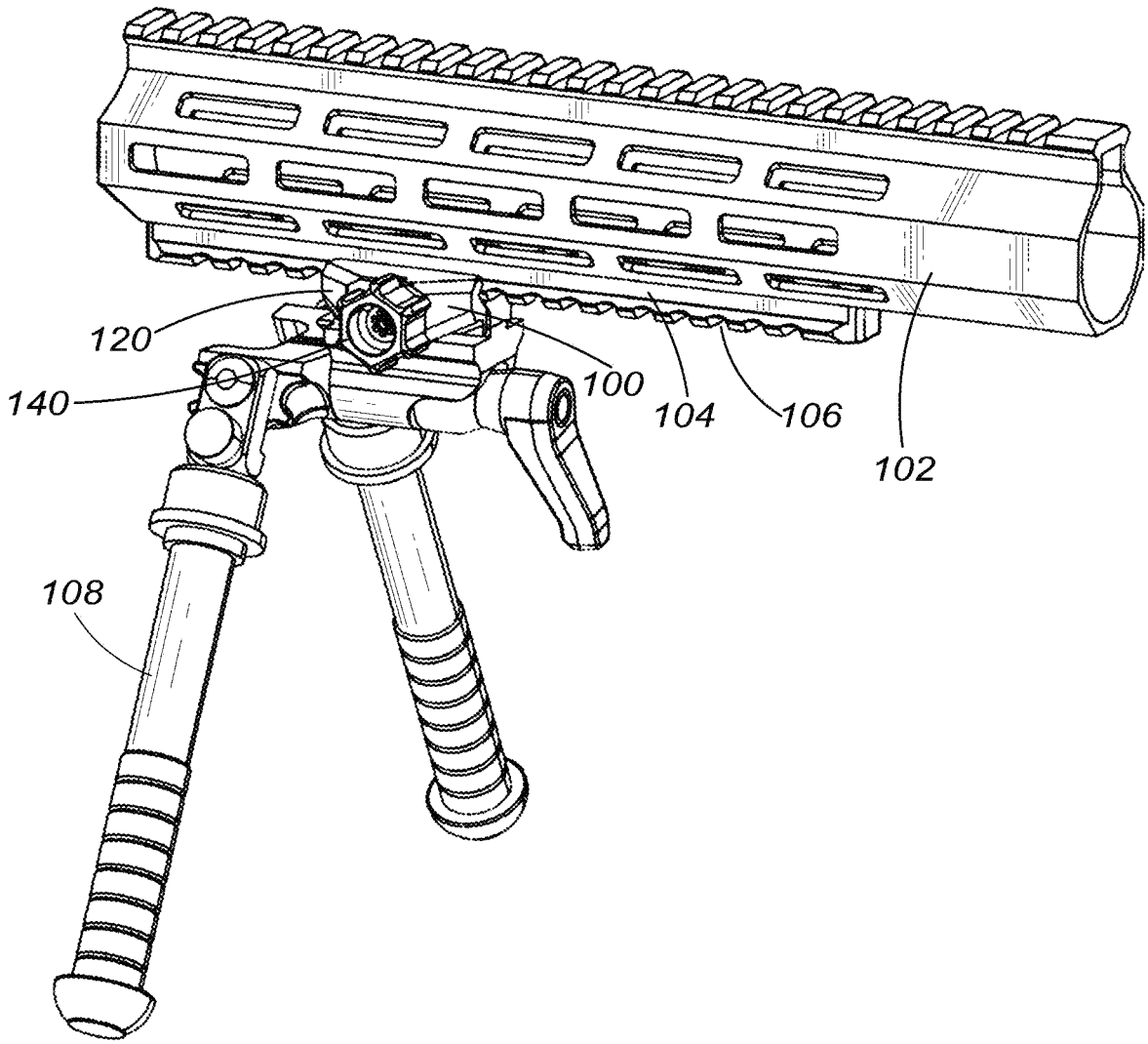
FIGS. 19 and 20 illustrate perspective views of the accessory mount shown in FIG. 1 attached to a rail interface system on a handguard for a firearm.
Figure 20:
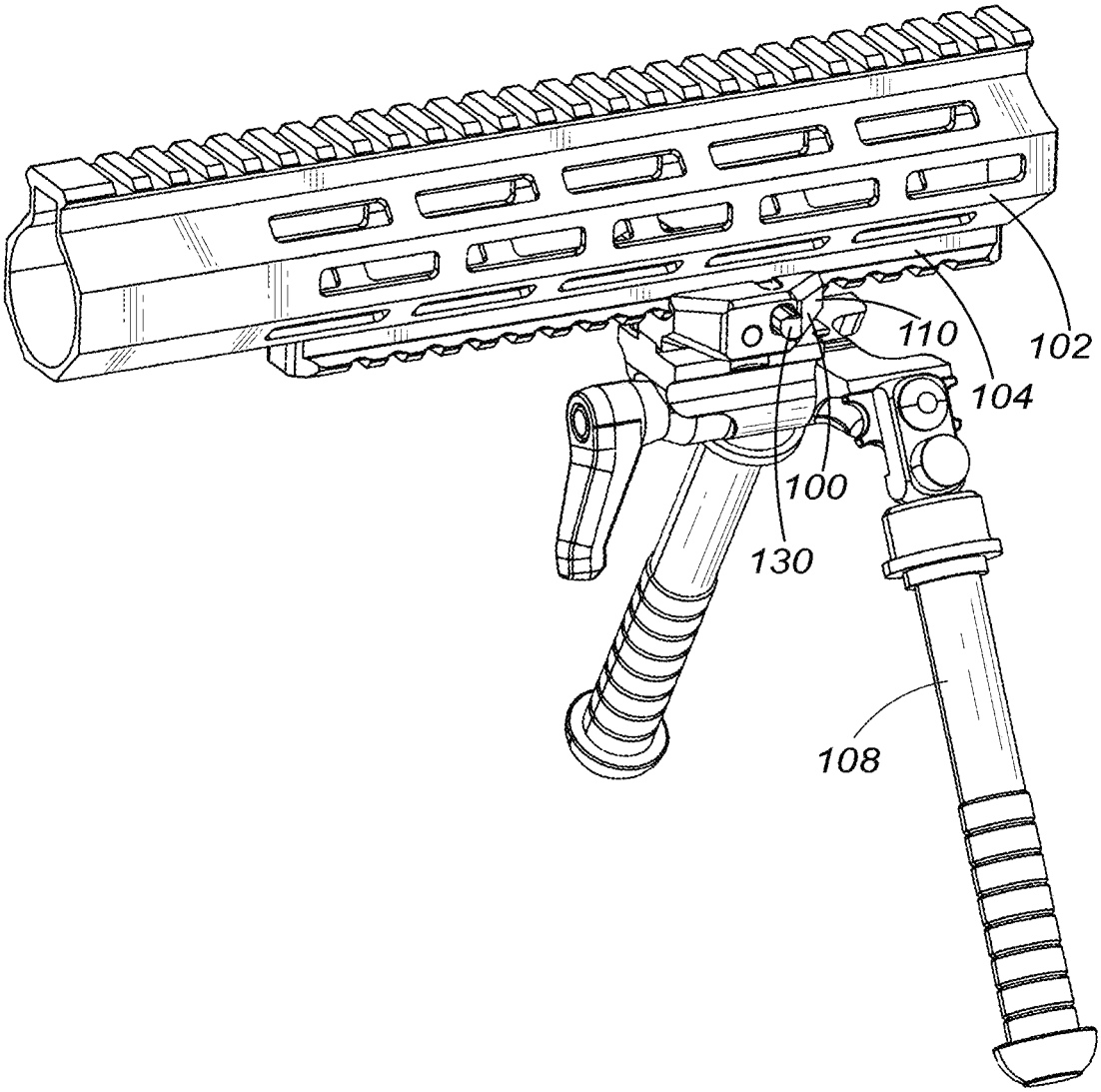

Are shown best in FIG. 18, the lobes 147, 167 on the adjustment knob 140 and collar 160 are configured to be received within the spaces 149, 169 defined by the collar 160 and the adjustment knob 140, respectively.

The body 110, clamp 120, and adjustment knob 140 of the accessory mount 100 are fabricated from an aluminum alloy (e.g., 6061-T651 aluminum). However, the body 110, clamp 120, and/or adjustment knob 140 could instead be fabricated from another suitably strong and lightweight material, such as steel or titanium.

The push-button recoil lug 130 of the accessory mount 100 is fabricated from a stainless-steel alloy. However, the push-button recoil lug 130 could instead be fabricated from another suitably strong and lightweight material, such as titanium.

The foregoing description of the invention is intended to be illustrative; it is not intended to be exhaustive or to limit the claims to the precise forms disclosed. Those skilled in the relevant art can appreciate that many modifications and variations are possible in light of the foregoing description and associated drawings.

Reference throughout this specification to an "embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. An accessory mount configured for attachment to a rail interface system, the accessory mount comprising:
- a base comprising a receiving groove;
- a clamp comprising a receiving groove;
- a push-button recoil lug comprising an actuating arm, with an actuation button on one end and a recoil lug on the opposite end; and
- an adjustment knob;
- wherein:
- a channel is defined between the receiving groove of the base and the receiving groove of the clamp;
- the clamp is connected to the base by a threaded shank attached to the adjustment knob;
- rotation of the adjustment knob causes the clamp to move relative to the base, thereby selectively varying a width of the channel; and
- the push-button recoil lug is slidably positioned within a guide groove in the base and configured to removably position the recoil lug in the channel.

2. The accessory mount of claim 1, wherein the base and the clamp form a mounting interface for an accessory, the mounting interface comprising a longitudinally extending groove and a pair of bores extending through the base.

3. An accessory mount configured for attachment to a rail interface system, the accessory mount comprising:
- a base comprising a receiving groove;
- a clamp comprising a receiving groove;
- a push-button recoil lug comprising an actuating arm, with an actuation button on one end and a recoil lug on the opposite end;
- a spring; and
- an adjustment knob;
- wherein:
- a channel is defined between the receiving groove of the base and the receiving groove of the clamp;
- the clamp is connected to the base by a threaded shank attached to the adjustment knob;
- rotation of the adjustment knob causes the clamp to move relative to the base, thereby selectively varying a width of the channel;
- the push-button recoil lug is slidably positioned within a guide groove in the base and configured to removably position the recoil lug within the channel; and
- the push-button recoil lug is biased by the spring, which is positioned within a socket adjacent to the guide groove in the base.

4. The accessory mount of claim 3, wherein the spring presses against a bias lug extending into the socket through a longitudinal slot, the bias lug extending from a longitudinal side of the actuating arm.

5. The accessory mount of claim 4, wherein the base and the clamp form a mounting interface for an accessory, the mounting interface comprising a longitudinally extending groove and a pair of bores extending through the base.

6. An accessory mount configured for attachment to a rail interface system, the accessory mount comprising:
- a base comprising a receiving groove;
- a clamp comprising a receiving groove;
- a push-button recoil lug comprising an actuating arm, with an actuation button on one end and a recoil lug on the opposite end;
- an adjustment knob;
- a spring; and a collar;

wherein:

a channel is defined between the receiving groove of the base and the receiving groove of the clamp;

the clamp is connected to the base by a threaded shank attached to the adjustment knob;

rotation of the adjustment knob causes the clamp to move relative to the base, thereby selectively varying a width of the channel;

the adjustment knob includes a neck positioned within a bore on a lateral side of the clamp;

the spring and the collar are also positioned within the bore, with the collar being biased against a distal end of the adjustment knob by the spring;

cooperating mating surfaces on the collar and the distal end of the adjustment knob are configured to resist rotational movement of the adjustment knob until sufficient rotational force is applied to the adjustment knob; and the push-button recoil lug is slidably positioned within a guide groove in the base and configured to removably position the recoil lug in the channel.

7. The accessory mount of claim 6, wherein the neck of the adjustment knob includes a circumferential groove; and a fastener is disposed within an opening in the clamp, such that a tip of the fastener is received within the circumferential groove.

8. The accessory mount of claim 7, wherein the mating surface of the adjustment knob includes a series of convex lobes and concave spaces between the convex lobes, with the convex lobes and the concave spaces evenly distributed around the distal end of the adjustment knob; and the mating surface of the collar includes a series of convex lobes and concave spaces between the convex lobes, with the convex lobes and the concave spaces evenly distributed around an end of the collar.

9. The accessory mount of claim 8, wherein the base and the clamp form a mounting interface for an accessory, the mounting interface comprising a longitudinally extending groove and a pair of bores extending through the base.

* * * * *